US008968038B2

(12) United States Patent
Kida et al.

(10) Patent No.: US 8,968,038 B2
(45) Date of Patent: Mar. 3, 2015

(54) CONNECTOR APPARATUS

(71) Applicant: Yazaki Corporation, Tokyo (JP)

(72) Inventors: Kousuke Kida, Shizuoka (JP); Shinichi Ikemoto, Kanagawa (JP)

(73) Assignee: Yazaki Corporation, Tokyo (JP)

( * ) Notice: Subject to any disclaimer, the term of this patent is extended or adjusted under 35 U.S.C. 154(b) by 42 days.

(21) Appl. No.: 13/967,865

(22) Filed: Aug. 15, 2013

(65) Prior Publication Data

US 2014/0065849 A1 Mar. 6, 2014

(30) Foreign Application Priority Data

Aug. 31, 2012 (JP) ..... 2012-192359

(51) Int. Cl.

| | |
|---|---|
| ***H01R 13/62*** | (2006.01) |
| ***H01R 12/70*** | (2011.01) |
| ***H01R 13/629*** | (2006.01) |
| *H01R 12/72* | (2011.01) |

(52) U.S. Cl.

CPC ..... *H01R 12/7011* (2013.01); *H01R 12/7023* (2013.01); *H01R 13/62994* (2013.01); *H01R 12/722* (2013.01)

USPC ..... 439/752; 439/374

(58) Field of Classification Search

USPC ..... 439/752, 374, 595

See application file for complete search history.

(56) References Cited

U.S. PATENT DOCUMENTS

| | | | | |
|---|---|---|---|---|
| 6,435,897 | B1 * | 8/2002 | Paul et al. | 439/374 |
| 7,090,543 | B2 * | 8/2006 | Lee et al. | 439/752 |
| 2002/0115333 | A1 * | 8/2002 | Self | 439/374 |
| 2006/0189219 | A1 * | 8/2006 | Yamashita et al. | 439/752 |
| 2008/0305694 | A1 * | 12/2008 | Takahashi et al. | 439/752 |
| 2010/0099295 | A1 * | 4/2010 | Ohsumi et al. | 439/374 |
| 2010/0248528 | A1 * | 9/2010 | Matsumura et al. | 439/374 |
| 2013/0280949 | A1 * | 10/2013 | Suzuki et al. | 439/374 |

FOREIGN PATENT DOCUMENTS

| | | |
|---|---|---|
| JP | 2008171626 A | 7/2008 |
| JP | 2010129177 A | 6/2010 |

* cited by examiner

*Primary Examiner* — Gary Paumen

(74) *Attorney, Agent, or Firm* — Sughrue Mion, PLLC

(57) ABSTRACT

A connector apparatus includes a board mounting connector mounted on a board housed in a housing case, a mating connector fit to the board mounting connector, and a guide hood that has a connector fitting part to guide insertion of the mating connector and is fit into an opening section of the housing case. The board mounting connector has a recessed fitting part, into which a housing front-end side fitting part of the mating connector is inserted. A connector fitting part of the guide hood has a second opening whose width is wider than a width of a first opening of the recessed fitting part and is substantially equal to a width of a housing rear-end side fitting part of the mating connector. A retainer is held in a housing rear-end side fitting part of the mating connector.

2 Claims, 8 Drawing Sheets

CONNECTOR APPARATUS

BACKGROUND

The present disclosure relates to a connector apparatus.

A surface mounting technology (SMT) connector (a board mounting connector) may be mounted in an electronic apparatus such as ECU (Electro Control Unit). There is a known connector including a first housing having a terminal locking lance which makes a primarily lock for a terminal, and a second housing, which is mounted to the first housing from a direction orthogonal to the terminal inserting direction to make a secondarily lock to the terminal (refer to JP-A-2008-171626 and JP-A-2010-129177, for example).

A connector 501 disclosed in JP-A-2008-171626 includes an inner housing 503 made of synthetic resign, and an outer housing 505 made of synthetic resign, as shown in FIG. 8. The inner housing 503 has a substantially box-shape, and is provided with a fitting groove 507, a lock arm 509, a pair of left and right side surfaces, a guide projection 513, and a final locking projection 515. The fitting groove 507 extends in an orthogonal direction Y3 orthogonal to a plane including a terminal inserting direction Y1 and a housing mounting direction Y2, and fits with a spacer 517 (a retainer) of an outer housing 505. The guide projection 513 is provided along the housing mounting direction Y2 so as to slidably fit in a guide groove 519 of the outer housing 505 with extending in the housing mounting direction Y2. The outer housing 505 is formed in one unit with a bottom cover 521, a front unit 523, a pair of side covers 525, a guide groove 519, a swollen part 527, and a spacer 517 as described above.

When mounting the connector 501, firstly, slide the outer housing 505 in the housing mounting direction Y2 with fitting the guide projection 513 along the guide groove 519, and fix it at a temporary locking position of the inner housing 503. At this timing, the spacer 517 is inserted into the fitting groove 507 of the inner housing 503. Then, insert a female terminal (not-shown) into a female terminal insertion hole 529 in the terminal inserting direction Y1. When the female terminal is completely inserted into a terminal receiving chamber 531, a terminal locking lance temporarily locks a lance locking step portion, and the female terminal is housed and held in the terminal receiving chamber 531. Finally, by pressing the outer housing 505 further in the housing mounting direction Y2, a spacer locking step portion of the female terminal is finally locked by the spacer 517. In this manner, the spacer 517 locks the female terminal at a final locking position so that the female terminal is not detached out of the terminal receiving chamber 531 even if the locking of the female terminal by the terminal locking lance is released.

There is a conventional connector apparatus, in which the board mounting connector is coupled with the connector 501 having a retainer (for example, a harness side connector).

The connector 501 having a retainer is configured such that a pair of side covers 525 is disposed on both sides of an external width that is the orthogonal direction Y3 of the spacer 517 so that the outer housing 505 is integrally formed with said pair of side covers 525 forming its both sides. Therefore, as to the connector 501 with the outer housing 505 fitting over the inner housing 503, the external size of said pair of side covers 525 becomes its external width. As a result, a board mounting connector formed by receiving the connector 501 inwardly should have an external width larger than the external width of the pair of side covers 525. However, a board mounting connector to be mounted on a board has a restriction in its external width due to differences in tolerance such as a linear expansion coefficient, flatness, curvature, and so on. Therefore, it is common to employ a plurality of board mounting connectors, such as each having small number of terminals with short external width, to be disposed in an opening-widthwise direction. For instance, when 120 pins of terminal are required, three board mounting connectors, each having 40-pins, are provided side by side. Further, such a board mounting connector is required for having a part at both ends of an opening-widthwise direction so that a reinforcing metal for fixing another board can be provided. Therefore, accumulating such a part as the number of connectors to be provided side by side increase may result in a proportional increase of the external width. Thus, a conventional board mounting connector has a problem such that occupancy of a board mounting area becomes large.

SUMMARY

The present disclosure has been made in view of the above circumstances. It is an object of the invention to provide a connector apparatus configured to lower the occupancy of a board mounting area by reducing an external width of a board mounting connector.

The object of the present disclosure is achieved by the following configurations. There is provided a connector apparatus, comprising:

a board mounting connector configured to be mounted on a board housed in a housing case and to be disposed at an opening section of the housing case;

a mating connector fit to the board mounting connector; and a guide hood configured to have a connector fitting part to guide insertion of the mating connector corresponding to the board mounting connector, and to be fit into the opening section of the housing case, wherein a housing of the board mounting connector has a recessed fitting part, into which a housing front-end side fitting part of the mating connector is inserted;

wherein a connector fitting part of the guide hood has a second opening, and a width of the second opening is wider than a width of a first opening of the recessed fitting part and is substantially equal to a width of a housing rear-end side fitting part of the mating connector; and wherein a retainer for locking a terminal contained in the mating housing is housed and held in a housing rear-end side fitting part of the mating connector.

According to the above configuration, the housing rear-end side fitting part of the mating connector which houses and holds the retainer is guided for the insertion into the connector fitting part of the guide hood, and only the housing front-end side fitting part with an external width narrower than the housing rear-end side fitting part is inserted into the recessed fitting part of the housing of the board mounting connector. Thus, an external width of the board mounting connector can be reduced by the difference between the external widths of the housing rear-end side fitting part and the housing front-end side fitting part. As a result, the board mounting connector can be reduced in occupancy of a board mounting area of the board.

For example, the guide hood has a plurality of connector fitting parts to guide insertion of a plurality of the mating connectors corresponding to a plurality of the board mounting connectors disposed in a width direction of the second opening of the guide hood.

According to the above configuration, a total external width can be reduced by disposing THE plurality of board mounting connectors in the width direction of the second opening of the guide hood.

According to the connector apparatus described above, occupancy of a board mounting area can be lowered by reducing an external width of a board mounting connector.

Hereinbefore, the disclosure has been briefly explained. Details of the disclosure will be further clarified by reading through the following description of modes for carrying out the invention (hereinafter, referred to as modes) with reference to the accompanying drawings.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
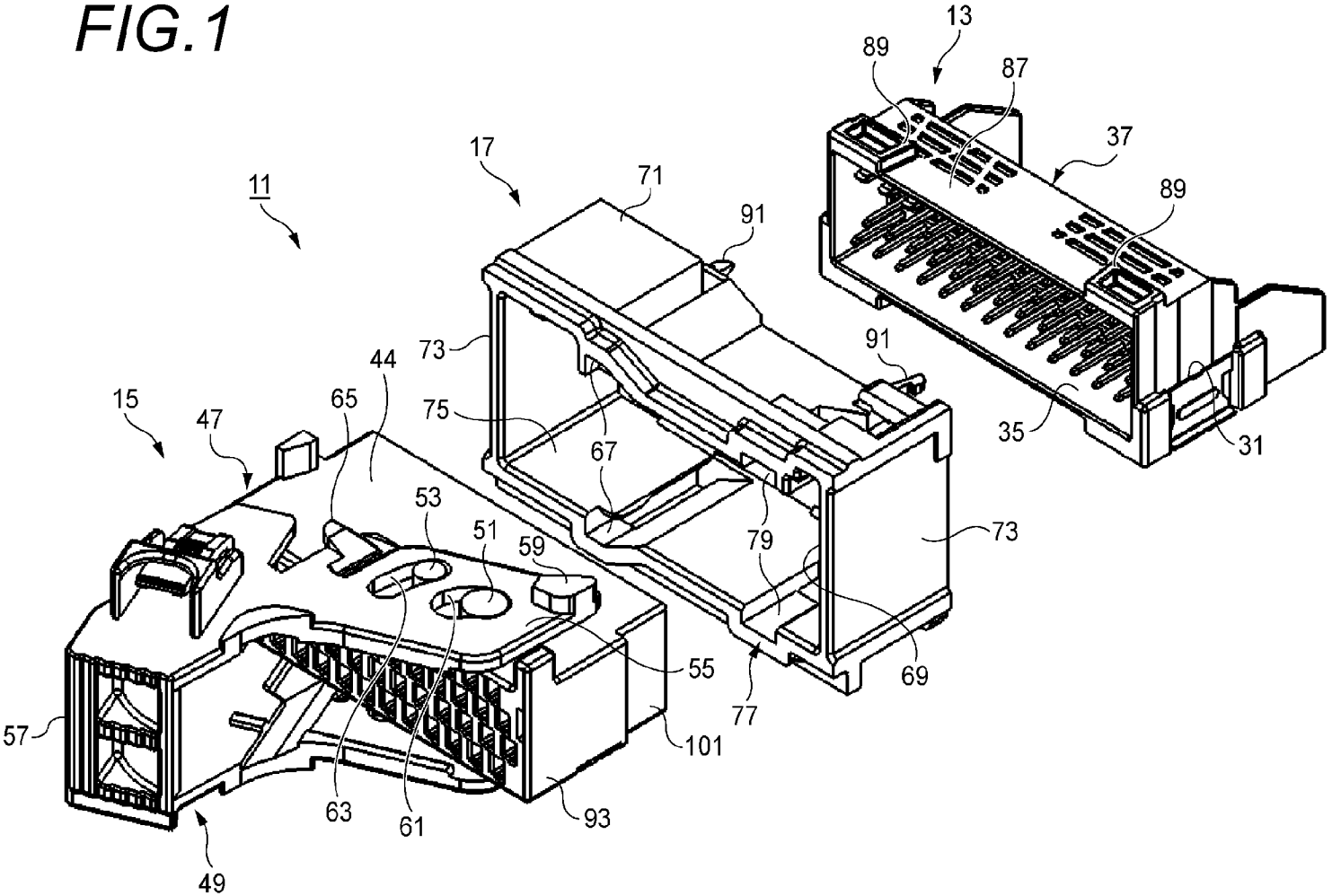
FIG. 1 is an exploded perspective view of a connector apparatus according to an embodiment of the invention.

Hereinafter, an embodiment of the invention will be explained with reference to the accompanying drawings. A connector unit according to the embodiment includes a plurality of connector apparatus 11, as shown in FIG. 1, having a board mounting connector 13, a harness side connector 15 as the mating connector, and a guide hood 17. The board mounting connector 13 is a so-called SMT connector. In the embodiment, the board mounting connector 13 is a male connector housing a male terminal 19 (refer to FIG. 6), and the harness side connector 15 is a female connector housing a female terminal (a terminal) 21 (refer to FIG. 6). In the connector apparatus 11 according to the invention, male terminals and female terminals are respectively housed in the board mounting connector 13 and harness side connector 15, however, this combination in the embodiments described in this specification may be changed to the reversed combination.

Figure 7:
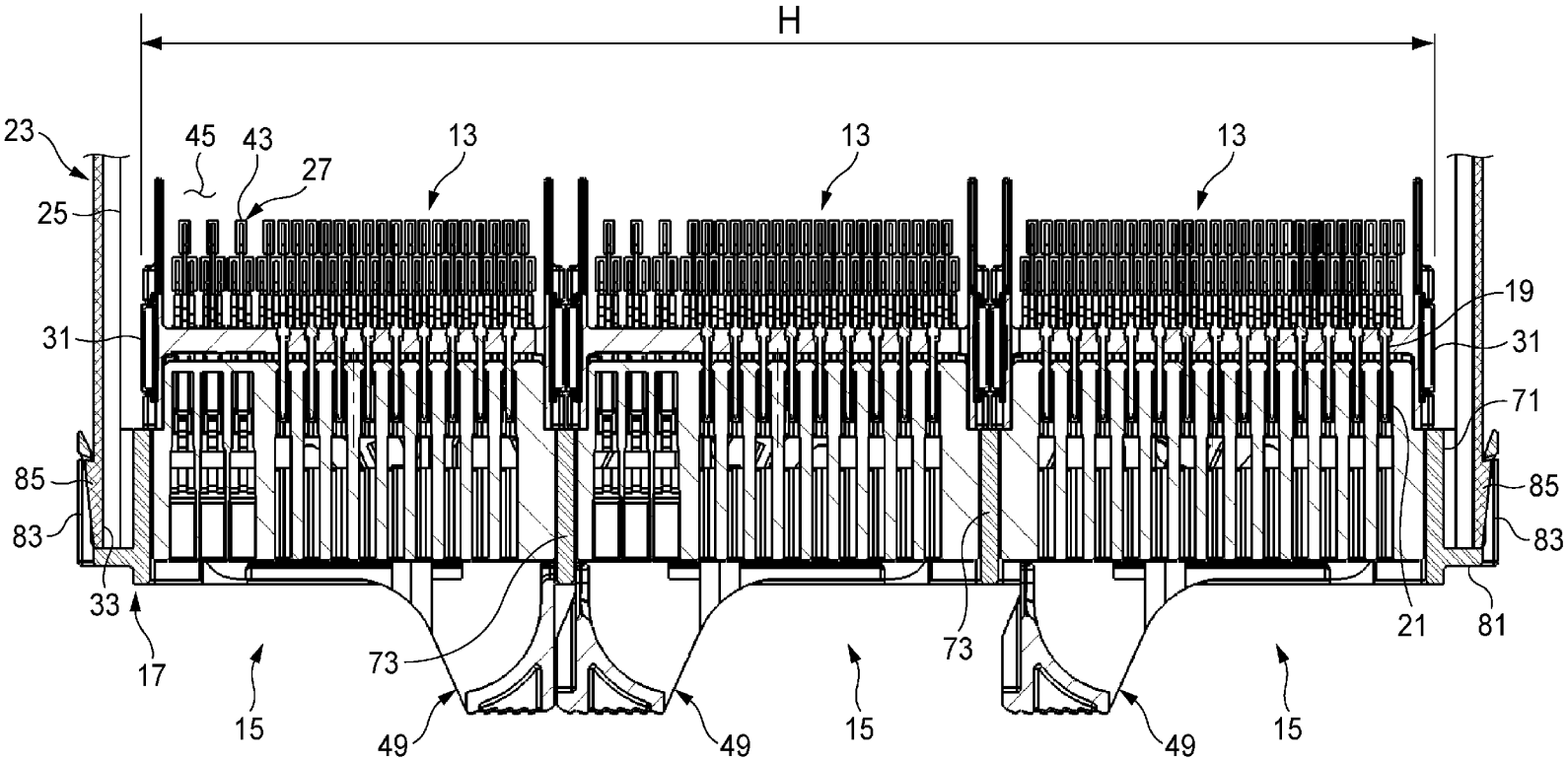
FIG. 7 is a horizontal sectional view of a connector apparatus, in which three board mounting connectors shown in FIG. 1 are mounted side by side in an opening width direction.
Figure 8:
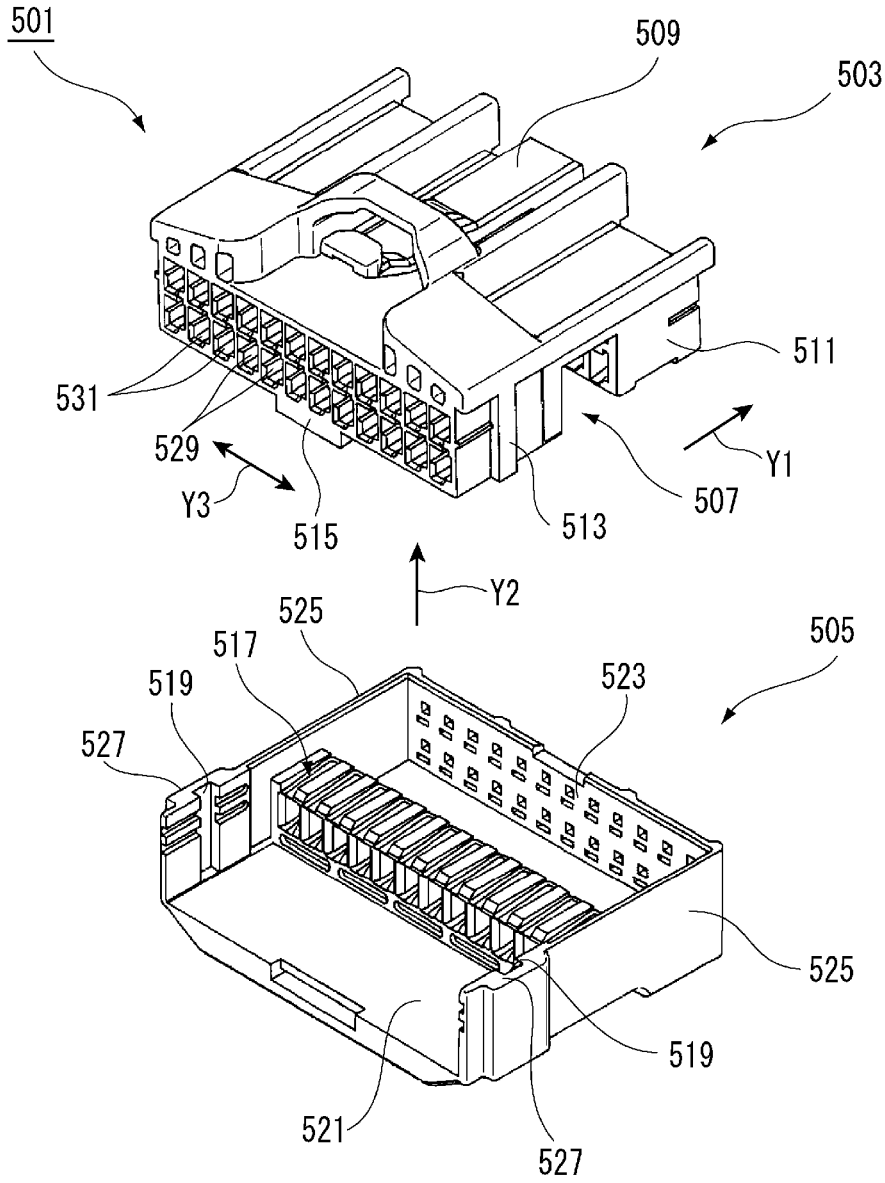
FIG. 8 is an exploded perspective view of a conventional connector provided with a retainer.

The board mounting connector 13 is surface-mounted by soldering a soldering part 27 to a board 25 housed in a flat rectangular housing case 23 (refer to FIG. 7). In addition, both ends of the board mounting connector 13 are also fixed to the board 25 by using a reinforcing metal 31 (refer to FIG. 1). In this way, without using throughholes, the connector apparatus 11 according to the embodiment can realize its low-profile mounting structure. As a housing case 23, an outer cabinet of an ECU may be used, for example. The housing case 23 is fastened to a vehicle body with fasteners such as bolts and nuts. The board 25 is further fixed to an inside of the housing case 23 with fasteners such as screws. A flat rectangular opening 33 (refer to FIG. 7) is formed in the housing case 23. Along a longitudinal direction of the opening 33, two or more (three in the embodiment) board mounting connectors 13 are arranged side by side with a recessed fitting part 35 (refer to FIG. 1) for fitting with the harness side connector 15 directed to the front.

In the embodiment, for example, two or more harness side connectors are coupled with two or more board mounting connectors 13 respectively. However, as to the connector unit according to the invention, it may be also constituted from a single harness side connector 15 and a single board mounting connector 13, being coupled together.

In the board mounting connector 13, a plurality of male terminals 19 is press-fitted to a mounting connector housing (a housing) 37 made of insulating synthetic resin. In the press-fitted male terminal 19, an electric contact portion 39 (refer to FIG. 6) in a front-end side is arranged side by side in the recessed fitting part 35, enabling the plurality of male terminals 19 to contact the female terminal 21. In the male terminal 19, an opposite side of the front-end across a press-in part 41 (refer to FIG. 6) is led out of the rear of the mounting connector housing 37 as a board fixing part 43. The led-out board fixing part 43 is bent in a direction vertical to the board 25, curved along the board 25, and fixed to the board 25 by soldering to a conductor of a board surface 45 (refer to FIG. 7). In other words, the board mounting connector 13 is fixed to the board 25 by the soldering portion 27.

The harness side connector 15 is provided in two or more arrangement (three in the embodiment) depending on the number of the board mounting connector 13 to be used. Each harness side connector 15 may be configured to have either the same terminal arrangement or different terminal arrangement. In the embodiment, concerning the three same harness side connectors 15, the rightmost one shown in FIG. 7 has a terminal arrangement different from those employed for the remaining ones. A harness side connector 15 includes a harness side connector housing 47 made of insulating synthetic resin, a female terminal 21 housed in the harness side connector housing 47, and an insertion/removal lever 49 that is a kind of lever. The harness side connector housing 47 has side surfaces 44 opposing each other. In the middle of the longitudinal direction of the side surface 44, a first columnar boss 51 and a second columnar boss 52 are disposed apart from each other.

The insertion/removal lever 49 is made of insulating synthetic resin, arranged in parallel to each other, and provided with a pair of side plates 55 with one ends separated from each other, and an operation part 57 connecting the other ends of the pair of side plates 55. The operation unit 57 acts as a force point when rotating the insertion/removal lever 49. The side plate 55 is provided with an engaging projection 59 in one end. The engaging projection 59 enters an engaging projection receiving groove provided in the guide hood 17 described later, thereby engaging with the guide hood 17. The engaging projection 59 acts as a force point of the insertion/removal lever 49. In an area closer to the other end than the engaging projection 59, a pair of first boss receiving hole 61 and second boss hole 63, which fits with the first boss 51 and second boss 53 respectively, are provided. The first boss receiving hole 61 and second boss receiving hole 63 acts as an action point when rotating the insertion/removal lever 49.

Further, the side plate 55 of the insertion/removal lever 49 is provided with a sliding claw 65 on the opposite side of the engaging projection 59, across the first boss receiving hole 61 and second boss receiving hole 63. The sliding claw 65 moves into a guide groove provided in the guide hood 17 as will be described later.

The guide hood 17 has a connector fitting part 69 to guide insertion of the harness side connector 15 to meet the board mounting connector 13. In other words, the guide hood 17 is formed in a square cylindrical shape with a hood body 71 opened at both ends. The hood body 71 is inserted into the opening 33 of the housing case 23. In the hood body 71, the connector fitting part 69 to accept the harness side connector 15 is divided by a partition wall 73 depending on each board mounting connector 13. In other words, the guide hood 17 is configured to enable slot (insertion) of a plurality of board mounting connectors 13 in a single food structure.

An inner wall 75 (refer to FIG. 1) of each connector fitting part 69 is provided with an operation mechanism 77 for the insertion/removal lever 49. The operation mechanism 77 comprises an engaging projection guide groove 79, an engaging projection receiving groove (not-shown), a tapered wall (not-shown), and a guide groove 67. The engaging projection guide groove 79 extends to the back side of the connector fitting part 69 along the connector fitting direction. The engaging projection receiving groove continues to an end of the engaging projection guide groove 79, and extends in the direction crossing the engaging projection guide groove 79. The tapered wall is formed to be inclined with respect to the connector fitting direction, in a part connecting the engaging projection guide groove 79 and engaging projection receiving groove. The guide groove 67 is provided substantially parallel to the engaging projection guide groove 79, and is extended to the back side of the connector fitting part 69 along the connector fitting direction. In the connector apparatus 11, the board mounting connector 13 and harness side connector 15 are fitted by rotation of the insertion/removal lever 49 of the harness side connector 15 engaging with the operation mechanism 77 of the connector fitting part 69.

In one end side of a square cylinder axis of the hood body 71, a flange 81 projecting outside in circumference (refer to FIG. 7) is provided. The flange 81 contacts the peripheral edge of the opening 33 by inserting the hood body 71 into the opening 33 of the housing case 23. With this structure, when the harness side connector 15 is inserted into the connector fitting part 69 of the guide hood 17, a space between the harness side connector 15 and opening 33 is capped by the flange 81. In other words, the guide hood 17 acts also as a cover to close the opening 33 of the housing case 23. A frame-shaped locking part 83 is provided in the middle of each of four sides of the flange 81. The frame-shaped locking part 83 is engaged with a wedge-shaped lock 85. This prevents the guide hood 17 from being detached out of the opening 33, and the guide hood 17 is housed in the housing case 23.

In the mounting connector housing 37 of the board mounting connector 13, a pair of locking parts 89 are protrudingly provided at the left and right ends on the upper surface of the upper wall 87 of the recessed fitting part 35 (refer to FIG. 1) along the longitudinal direction of the recessed fitting part 35. The locking part 89 is formed in a square frame shape.

On the other hand, the guide hood 17 is provided with a lock unit, which can lock and engage with the board mounting connector 13 by elastically engaging with the locking part 89 of the board mounting connector 13 in the direction of providing the board mounting connector 13 side by side. In the embodiment, the lock unit is formed as a flexible lock arm 91 extending in the connector fitting direction. In other words, the lock arm 91 is, as shown in FIG. 1, arranged in a pair inside a pair of locking parts 89, and is formed to lock and engage with the board mounting connector 13 by that an end portion locks the locking part 89 from inside of a pair of locking parts 89.

Figure 2B:
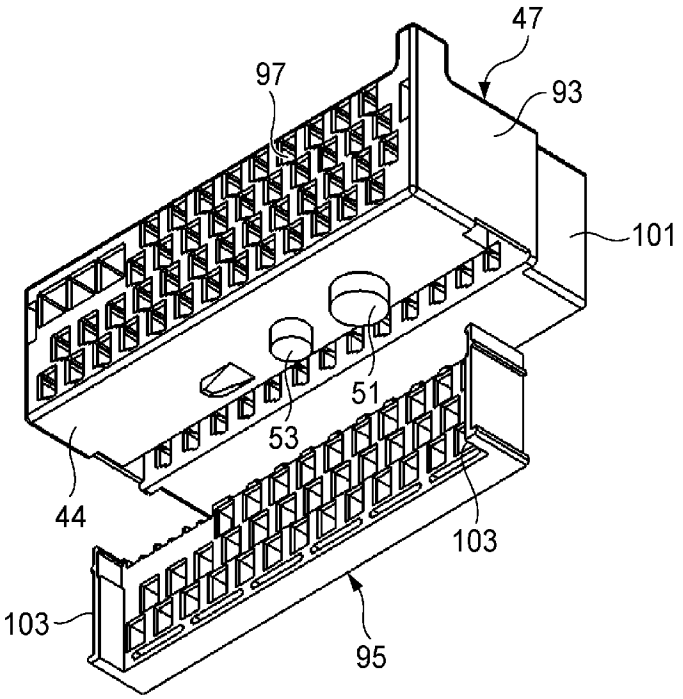
FIG. 2B is a perspective view of a retainer before insertion into a mating connector shown in FIG. 1, seen from the bottom front side.
Figure 2A:
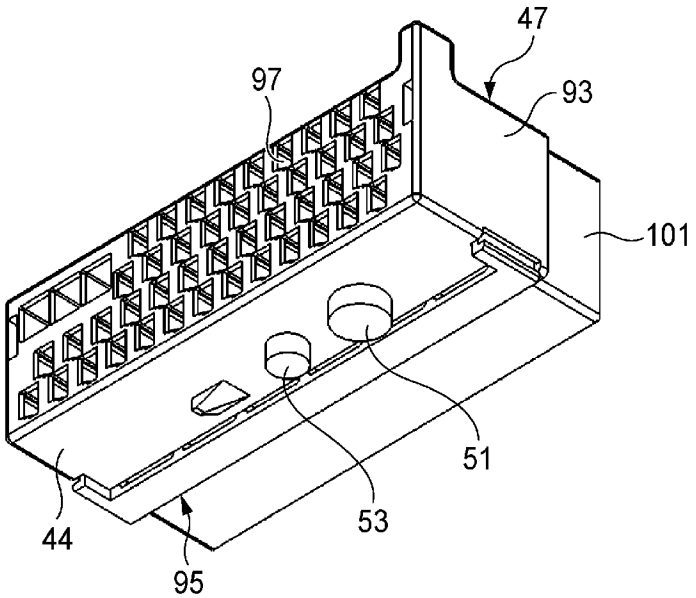
FIG. 2A is a perspective view of a retainer inserted into a mating connector shown in FIG. 1, seen from the bottom front side.
Figure 3A:
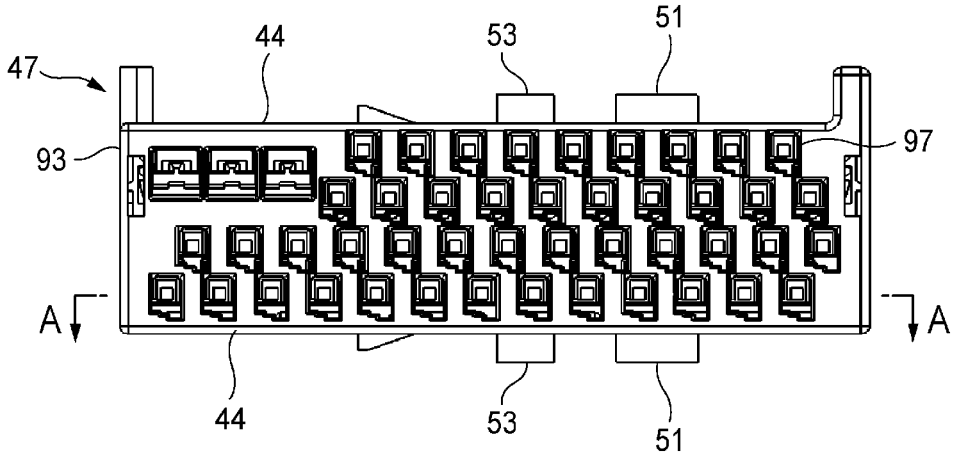
FIG. 3A is a front view of a mating connector shown in FIG. 2A, seen from a terminal mounting side.
Figure 3B:
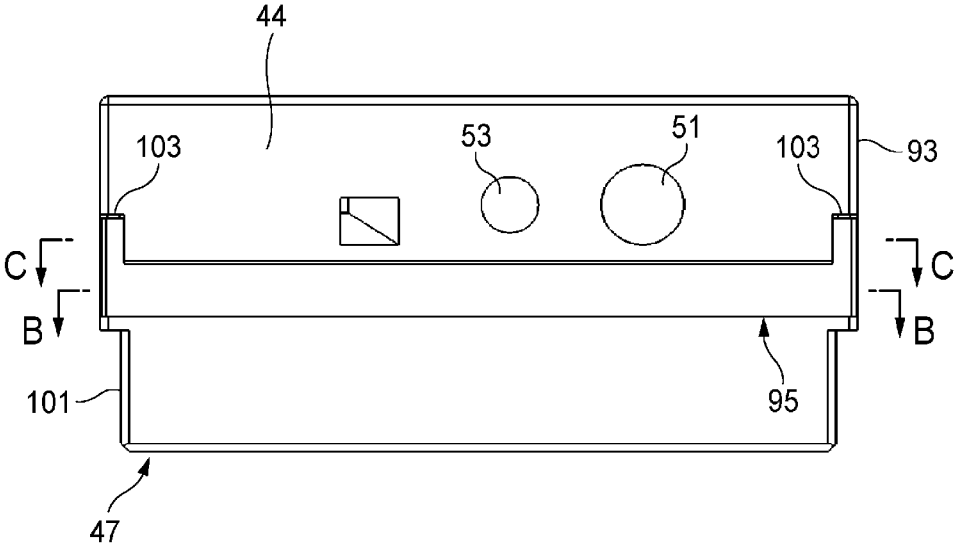
FIG. 3B is a bottom view of FIG. 2A.
Figure 4A:
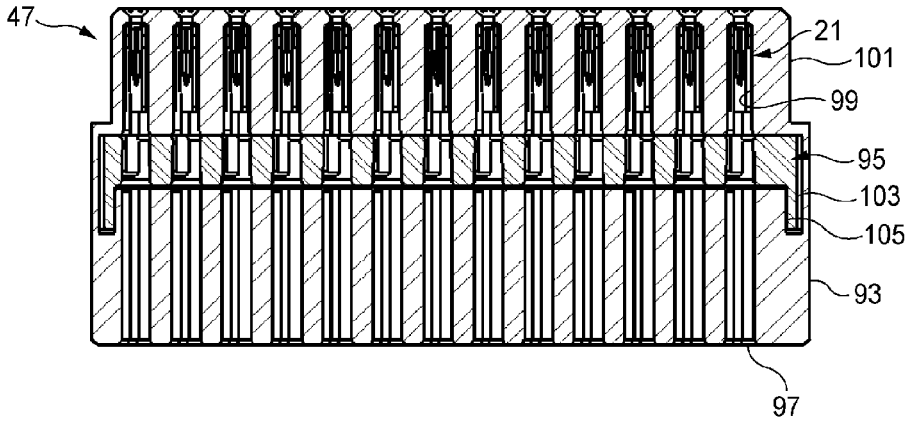
FIG. 4A is a cross sectional view taken along lines A-A of FIG. 3A.
Figure 4B:
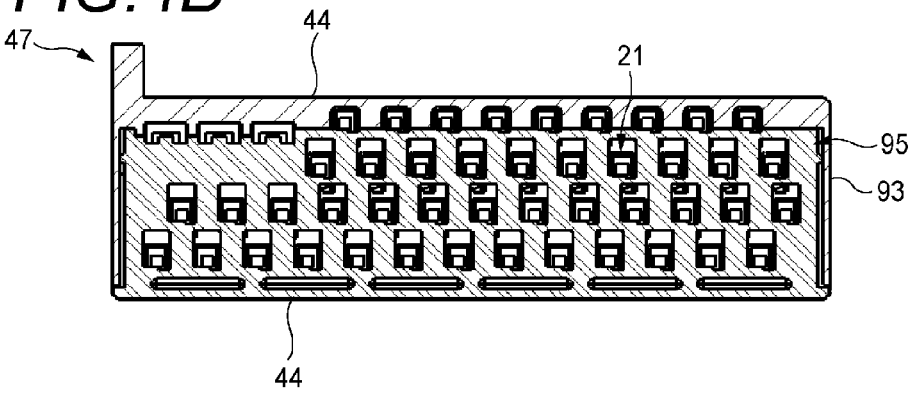
FIG. 4B is a cross sectional view taken along lines B-B of FIG. 3B.
Figure 4C:
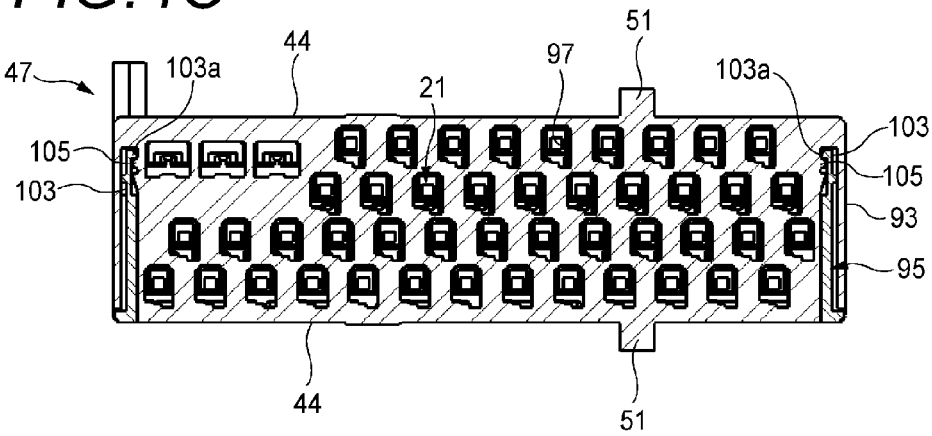
FIG. 4C is a cross sectional view taken along lines C-C of FIG. 3B.

As shown in FIG. 2A, in a housing rear-end side fitting part 93 of the harness side connector 15, a retainer 95 locking the housed female terminal 21 is housed and held. The female terminal 21 is inserted forward (rightward in FIG. 2A) from a female terminal insertion hole 97, with the retainer 95 at a temporary locking position shown in FIG. 2A. When the female terminal 21 is completely housed in the terminal receiving chamber 99 (refer to FIGS. 4A to 4C), a terminal locking lance (not-shown) temporarily locks a lance locking step portion (not shown) of the female terminal 21, and the female terminal 21 is housed and held in the terminal receiving chamber 99. Thereafter, when the retainer 95 temporarily locked on the housing rear-end side fitting part 93 is inserted moreover, a final lock is made to the retainer locking step portion of the female terminal 21 with the retainer 95. At the final locking position of the retainer 95, the retainer 95 locks the female terminal 21, and even when the locking of the female terminal 21 by the terminal locking lance is released, the female terminal 21 is not detached out of the terminal receiving chamber 99.

Figure 5B:
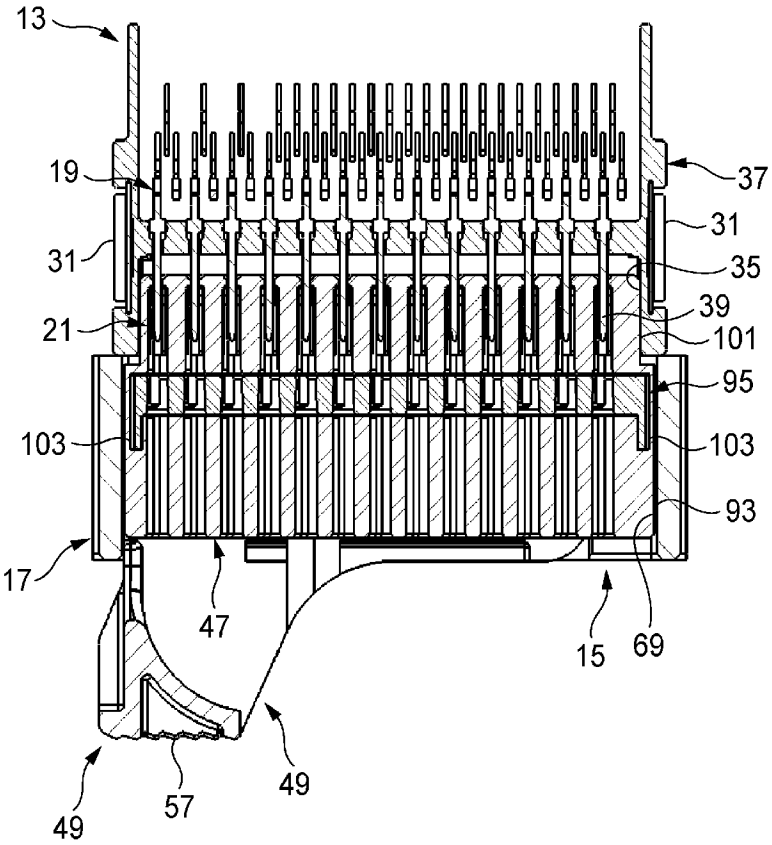
FIG. 5B is a horizontal sectional view of a board mounting connector and a mating connector after coupling.
Figure 5A:
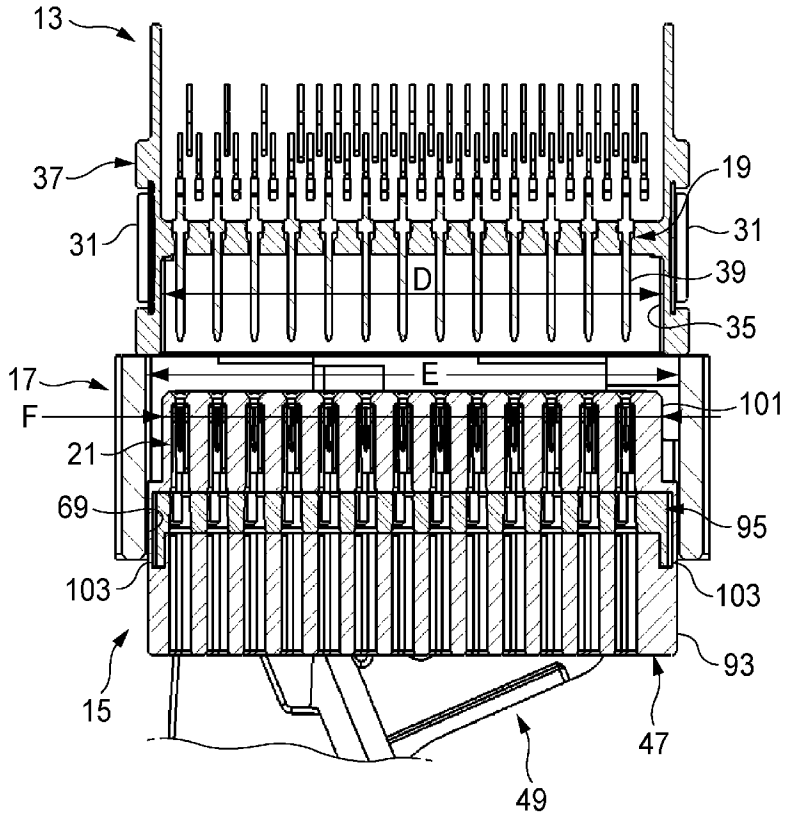
FIG. 5A is a horizontal sectional view of a board mounting connector and a mating connector before coupling.
Figure 6:
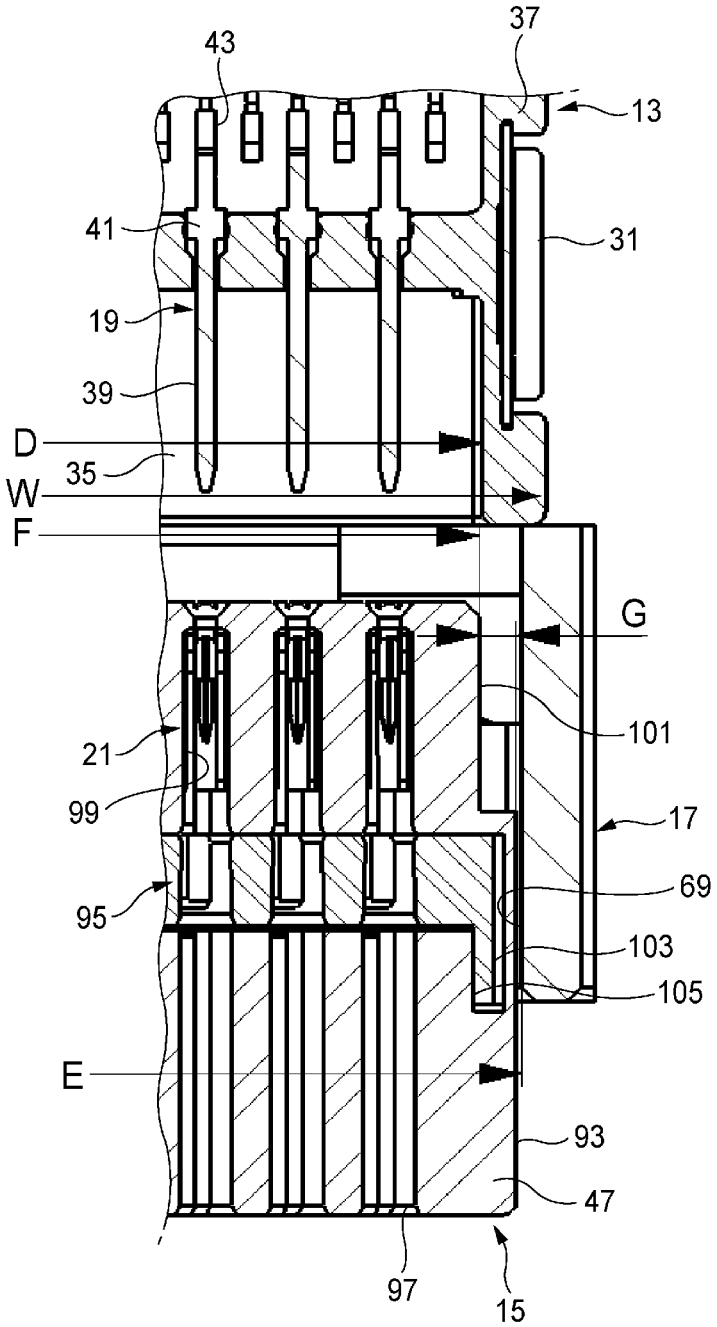
FIG. 6 is an enlarged view of essential parts of FIG. 5A.

The board mounting connector 13 according to the embodiment is provided with the recessed fitting part 35, into which a housing front-end side fitting part 101 (refer to FIGS. 2A and 2B) of the harness side connector 15 is inserted. As shown in FIGS. 5A and 5B and FIG. 6, in the guide hood 17, the connector fitting part 69 is formed to have a second opening width E, which is wider than a first opening width D of the recessed fitting part 35, and substantially equal to the housing rear-end side fitting part 93 of the harness side connector 15. The insertion width F of the housing front-end side fitting part 101 is a little narrower than the first opening width D of the recessed fitting part 35. Therefore, a gap G is formed between the housing rear-end side fitting part 93 and the housing front-end side fitting part 101.

Locking pieces 103 as shown in FIGS. 5A and 5B and FIG. 6 are provided at both ends of the opening-widthwise direction of the retainer 95 such as protruding to the opposite side of the housing front-end side fitting part 101. A locking projection 103*a* at the insertion end of the locking piece 103 is locked to the locking step portion 105 (refer to FIG. 4C) which is formed in the housing rear-end side fitting part 93. The locking piece 103 and locking step portion 105 are formed to fall within a size range of the gap G.

In the connector apparatus 11 according to the embodiment, as shown in FIG. 7, the guide hood 17 is provided with three connector fitting parts 69 corresponding to three board mounting connectors 13 provided side by side in the opening width direction.

Next, functions of the connector apparatus 11 configured as described above will be explained. In the connector apparatus 11 according to the embodiment, the board 25 is housed in the housing case 23, and a plurality of board mounting connectors 13 are mounted side by side on the board 25 so as to be disposed in the opening 33 of the housing case 23. Therefore, in the opening 33 of the housing case 23, a plurality of board mounting connectors 13 is arranged side by side. As shown in FIG. 5A, when the guide hood 17 is fit in the opening 33 of the housing case 23 (refer to FIG. 7), the connector fitting part 69 of the guide hood 17 is arranged to meet each board mounting connector 13.

Before fitting with the board mounting connector 13, the harness side connector 15 is inserted into the connector fitting part 69 of the guide hood 17. In other words, as shown in FIG. 5B, the housing front-end side fitting part 101 of the harness side connector 15 is finally inserted into the recessed fitting part 35 of the board mounting connector 13. Before direct insertion into the recessed fitting part 35 of the board mounting connector 13, the housing front-end side fitting part 101 is inserted into the connector fitting part 69 of the guide hood 17 having the opening larger than the recessed fitting part 35 of the board mounting connector 13, and then guided into the recessed fitting part of the board mounting connector 13. This facilitates positioning of the housing front-end side fitting part 101 with respect to the board mounting connector 13.

The board mounting connector 13 and harness side connector 15 are coupled by a low insertion force of a lever action. Namely, when the insertion/removal lever 49 provided in the harness side connector 15 is rotated, the harness side connector 15 is engaged and drawn to the connector fitting part 69 so that coupling with the board mounting connector 13 can be made with a low insertion force by the action of the insertion/removal lever 49.

In other words, the harness side connector 15 is inserted into the connector fitting part 69 of the guide hood 17, and the engaging projection 59 of the insertion/removal lever 49 is disposed in the fitting projection guide groove 79. At this time, the sliding claw 65 of the insertion/removal lever 49 is also disposed in the guide groove 67 of the connector fitting part 69. In this state, the male terminal 19 and female terminal 21 are not conducting. When the insertion/removal lever 49 is rotated, the engaging projection 59 is picked up by the tapered wall, and pulled into the engaging projection receiving groove. The first boss receiving hole 61 and second boss receiving hole 63 form an action point of the insertion/removal lever 49, and push the first boss 51 and second boss 53 to the back side of the connector fitting direction. Thus, the female terminal 21 is electrically connected to the male terminal 19, and the coupling of the harness side connector 15 and board mounting connector 13 is completed.

In the connector apparatus 11 to be coupled in this manner, as shown in FIGS. 5A and 5B and FIG. 6, the housing rear-end side fitting part 93 of the harness side connector 15 housing and holding the retainer 95 is guided to and inserted into the connector fitting part 69 of the guide hood 17. Only the housing front-end side fitting part 101 of the harness side connector 15, whose external width (the width of the female terminal 21 in the alignment direction) is narrower than the housing rear-end side fitting part 93, is inserted into the recessed fitting part 35 of the mounting connector housing 37.

Therefore, according to the connector unit including the connector apparatus 11 in the embodiment, the occupancy of the board mounting area can be reduced by decreasing the external width W of the board mounting connector 13 by the difference (that is, by the gap G) between the external widths of the housing rear-end side fitting part 93 and the housing front-end side fitting part 101. Further, as shown in FIG. 7, when a plurality of board mounting connectors 13 are arranged in the opening-widthwise direction, the total external width H can be also effectively narrowed.

The invention is not to be limited to the embodiment described hereinbefore. Various modifications and improvements are possible when necessary. In addition, material, shape, size, number, and location of each component are optional, and not restrictive as long as the invention can be achieved.

The present application is based on Japanese Patent Application No. 2012-192359 filed on Aug. 31, 2012, the contents of which are incorporated herein by reference.

What is claimed is:

1. A connector apparatus, comprising:

a board mounting connector configured to be mounted on a board housed in a housing case and to be disposed at an opening section of the housing case;

a mating connector fit to the board mounting connector; and a guide hood configured to have a connector fitting part to guide insertion of the mating connector corresponding to the board mounting connector, and to be fit into the opening section of the housing case, wherein a housing of the board mounting connector has a recessed fitting part, into which a housing front-end side fitting part of the mating connector is inserted;

wherein a connector fitting part of the guide hood has a second opening, and a width of the second opening is wider than a width of a first opening of the recessed fitting part and is substantially equal to a width of a housing rear-end side fitting part of the mating connector; and wherein a retainer for locking a terminal contained in the mating housing is housed and held in a housing rear-end side fitting part of the mating connector.

2. The connector apparatus according to claim 1, wherein the guide hood has a plurality of connector fitting parts to guide insertion of a plurality of the mating connectors corresponding to a plurality of the board mounting connectors disposed in a width direction of the second opening of the guide hood.

* * * * *